US010967238B1

(12) United States Patent
Young

(10) Patent No.: US 10,967,238 B1
(45) Date of Patent: Apr. 6, 2021

(54) GOLF SWING TRAINING APPARATUS AND METHOD

(71) Applicant: Charles Thomas Young, Portland, ME (US)

(72) Inventor: Charles Thomas Young, Portland, ME (US)

( * ) Notice: Subject to any disclaimer, the term of this patent is extended or adjusted under 35 U.S.C. 154(b) by 0 days.

(21) Appl. No.: 16/717,008

(22) Filed: Dec. 17, 2019

(51) Int. Cl.
*A63B 69/36* (2006.01)

(52) U.S. Cl.
CPC .... *A63B 69/36211* (2020.08); *A63B 69/3632* (2013.01); *A63B 2225/096* (2013.01)

(58) Field of Classification Search
CPC ..... A63B 69/36211; A63B 69/3621; A63B 69/3632; A63B 69/36; A63B 2225/096
See application file for complete search history.

(56) References Cited

U.S. PATENT DOCUMENTS 1,567,530 A * 12/1925 MacNaughton ... A63B 69/3621 473/229
1,633,527 A * 6/1927 Hansen ..... A63B 69/36211 473/229
1,960,787 A * 5/1934 MacStocker ..... A63B 69/3667 473/229
2,653,025 A * 9/1953 Zega ..... A63B 69/36211 473/229
2,713,491 A * 7/1955 Plunkett ..... A63B 69/36211 473/259
2,756,056 A * 7/1956 Zega ..... A63B 69/36211 473/259
2,813,721 A * 11/1957 Zega ..... A63B 69/36211 473/259
2,868,543 A * 1/1959 Zega ..... A63B 69/36211 473/259
3,583,707 A * 6/1971 Fujimoto ..... A63B 69/36211 473/259
3,711,103 A * 1/1973 Seltzer ..... A63B 69/36211 473/229
3,730,531 A * 5/1973 Zega ..... A63B 69/36211 473/259
3,794,329 A * 2/1974 Wilson ..... A63B 69/36211 473/229
3,795,399 A * 3/1974 Beckish ..... A63B 69/36211 473/229
4,071,251 A * 1/1978 Beckish ..... A63B 69/36211 473/259
4,449,708 A 5/1984 Humphrey
4,486,020 A 12/1984 Kane et al.
(Continued)

FOREIGN PATENT DOCUMENTS

WO WO-2018120180 A1 * 7/2018 ..... A63B 69/36

*Primary Examiner* — Raleigh W Chiu
(74) *Attorney, Agent, or Firm* — Dunlap Bennett & Ludwig, PLLC; Brendan E. Squire

(57) ABSTRACT

A golf swing training apparatus and method of using the same. The swing training apparatus includes an orbital track and a carrier plate that connects a club shaft to the orbital track. The golf swing training apparatus guides the swing of the club shaft on a swing plan plane that is adjusted automatically to the golfer's anthropomorphic dimensions. A tension system provides a resistance during the golf swing to strengthen the muscles used in the golf swing. Repeated use of the golf swing training apparatus develops the golfer's muscle memory for maintaining the club shaft in a desired swing plane.

17 Claims, 7 Drawing Sheets

(56) References Cited

U.S. PATENT DOCUMENTS 4,653,757 A 3/1987 Wilkinson
4,852,881 A * 8/1989 Bellagamba ..... A63B 69/36211 473/216
4,949,974 A * 8/1990 Bellagamba ..... A63B 69/36211 473/216
5,026,065 A * 6/1991 Bellagamba ..... A63B 69/36211 473/216
5,069,456 A * 12/1991 Bellagamba ..... A63B 69/36211 473/264
5,188,367 A 2/1993 Gipe et al.
5,439,225 A * 8/1995 Gvoich ..... A63B 21/008 473/223
5,467,993 A * 11/1995 Higginson ..... A63B 69/36211 473/229
5,478,079 A 12/1995 Liberatore et al.
5,595,545 A * 1/1997 O'Brien ..... A63B 69/36211 473/259
5,672,118 A 9/1997 Robbie
5,716,286 A 2/1998 Swan
5,888,146 A 3/1999 Raynak
5,895,327 A * 4/1999 Francisco ..... A63B 69/36211 473/229
6,322,456 B1 * 11/2001 Benggon ..... A63B 69/0057 473/219
6,364,786 B1 * 4/2002 Khano ..... A63B 69/36211 473/257
6,656,055 B1 12/2003 Marro
7,238,116 B1 * 7/2007 Sulzener ..... A63B 69/3621 473/259
7,364,512 B2 4/2008 Graedener
7,611,420 B1 * 11/2009 Turner ..... A63B 69/3632 473/259
7,806,780 B1 * 10/2010 Plunkett ..... A63B 69/36213 473/257
8,267,812 B1 9/2012 Sery
9,855,483 B2 1/2018 Chiles
10,549,170 B1 * 2/2020 Staggs ..... A63B 53/023
2003/0109321 A1 6/2003 Novotny
2005/0075186 A1 * 4/2005 Liao ..... A63B 69/3621 473/259
2005/0176519 A1 * 8/2005 Elkins ..... A63B 69/3632 473/258
2008/0070712 A1 * 3/2008 Jones ..... A63B 69/3621 473/257
2008/0153618 A1 * 6/2008 Arther ..... A63B 69/3621 473/259
2010/0048315 A1 * 2/2010 Turner ..... A63B 69/36211 473/259
2010/0124998 A1 * 5/2010 Bailey ..... A63B 69/3621 473/259
2010/0216562 A1 * 8/2010 Van Rensburg ... A63B 69/3621 473/221
2011/0009204 A1 1/2011 Boldin
2013/0065704 A1 * 3/2013 Napolitano ..... A63B 69/36213 473/259
2013/0244804 A1 9/2013 Cochran
2013/0267340 A1 10/2013 Wolf
2014/0011602 A1 1/2014 Zimmerman et al.
2016/0089590 A1 * 3/2016 Hungelmann ..... A63B 15/00 473/215
2016/0129331 A1 5/2016 Zhang
2016/0243396 A1 8/2016 Taylor et al.
2018/0093155 A1 * 4/2018 Zimmerman, II . A63B 24/0087

* cited by examiner

GOLF SWING TRAINING APPARATUS AND METHOD

BACKGROUND OF THE INVENTION

The present invention relates to the game of golf and, more particularly, to training devices for golfer's to improve their golf swing.

A golfer's ability to swing a golf club to strike the ball determines how the golf ball will travel. If the golfer doesn't swing the club correctly, the golf ball will not end up at a desired location on the golf course. The swing plane, the arc in which the club and club head traverse during the golf swing, is a very important aspect of a proper golf swing and contributes to obtaining the desired direction and distance when striking the golf ball. If the swing plane is not correct, the game can be very frustrating and contributes to many weekend players not playing the game anymore.

As can be seen, there is a need for an improved golf swing training apparatus and method that develops muscle memory and strength while swinging a club in a desired swing plane.

SUMMARY OF THE INVENTION

In one aspect of the present invention, a golf swing training apparatus is disclosed. The golf swing training apparatus includes an orbital track that is pivotally adjustable in a desired golf swing plane. A club shaft and a carrier plate coupling the club shaft to the orbital track such that the club shaft is carried in the desired swing plane throughout a golf swing motion of the club shaft.

In some embodiments, a base is pivotally coupled to a bottom end of the orbital track proximal to a ball strike zone of a golf swinging movement. The orbital track is shaped to an ideal traversal path of a golf club to strike a golf ball. The orbital track may be defined by a progressively increasing radius between a back swing end of the orbital track and a follow through end of the orbital track.

In other embodiments, the golf swing training apparatus includes a stiffener interconnecting the back swing end and the follow through end of the orbital track to retain the orbital track in alignment in the desired swing plane.

In other embodiments, a plurality of support rods are configured to adjustably align the orbital track in the desired swing plane. A knuckle may be provided to interconnect the plurality of support rods.

In other embodiments, a channel is defined within the orbital track. A plurality of rollers are disposed about the carrier plate, with the plurality of rollers biased into engagement within the channel.

In yet other embodiments, a tension cable is disposed at one of a backswing end and a follow through end of the orbital track, the tension cable connected to the carrier plate to provide a selective resistance to the carrier plate as the carrier plate traverses the orbital track.

In other aspects of the invention, a method of golf swing training is disclosed. The method includes the steps of providing a golf swing training apparatus having an orbital track defined by a progressively increasing radius between a back swing end and a follow through end of the orbital track, a carrier plate coupled for traversal along the orbital track, and a club shaft attached to the carrier plate.

A swing plane of the orbital track is adjusted to accommodate one or more anthropomorphic measurements of a golfer training with the golf swing training apparatus. The longitudinal length of the club shaft adjusts automatically according the one or more anthropomorphic measurements during the swing movement.

The golfer swings the club shaft in the swing plane between the back swing end and the follow through end. In some embodiments, the method includes adjusting a tensioner cable operatively coupled to the carrier plate to provide a selected resistance to the club shaft when swung in the swing plane.

These and other features, aspects and advantages of the present invention will become better understood with reference to the following drawings, description and claims.

DETAILED DESCRIPTION OF THE INVENTION

Figure 1:
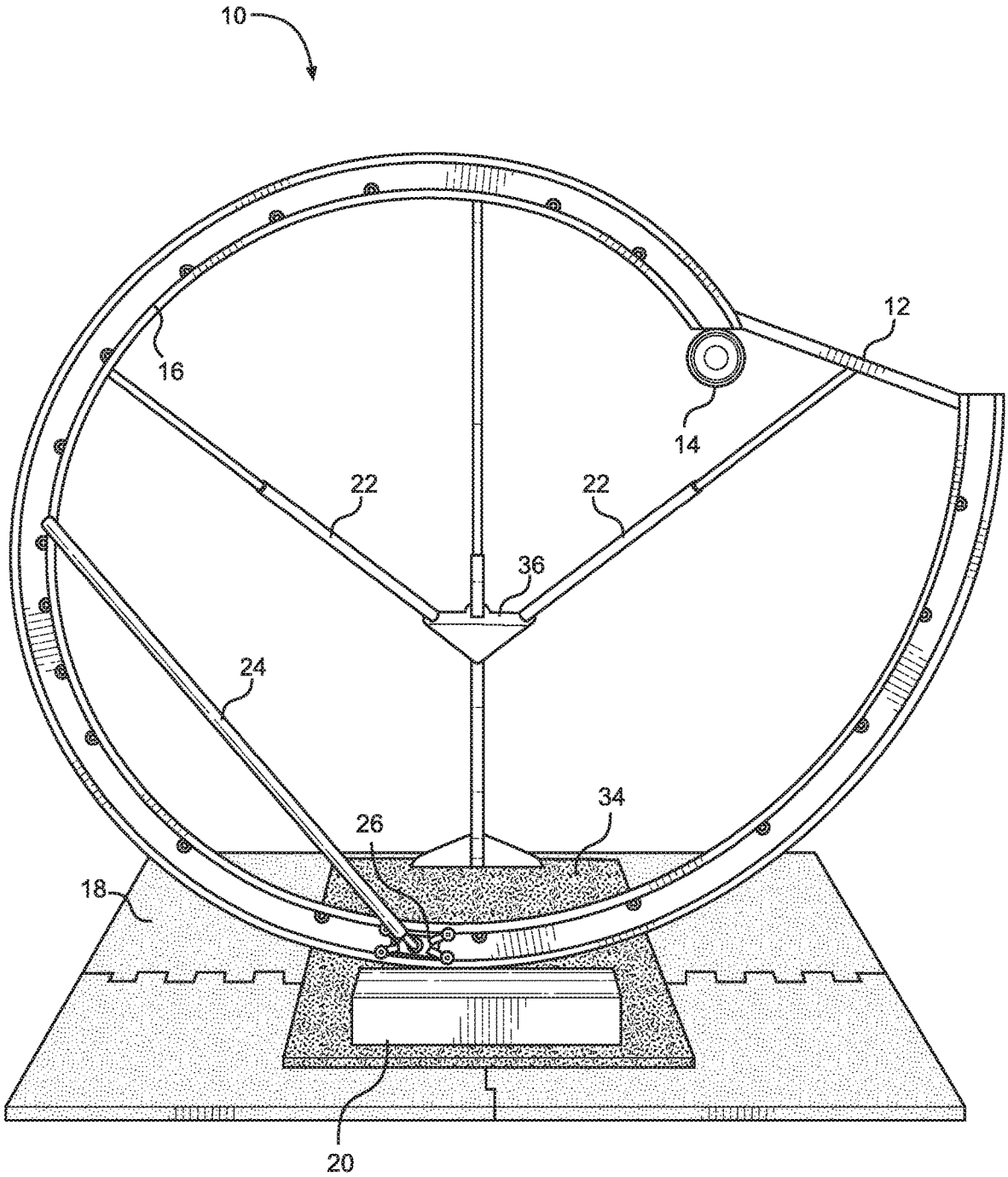
FIG. 1 is a front view of the golf swing trainer.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiment of the present invention provides an improved apparatus and method for golf swing training. The golf swing training apparatus allows a user to swing in the exact same path/motion every time as you would swing a golf club. It also strengthens the muscles that are used to swing a golf club. The device also helps with muscle memory by swinging in the same plan/path every time you swing using this device.

As seen in reference to the drawings of FIGS. 1-6, the golf swing training apparatus 10 includes an orbital track 16 that is pivotally carried on a base 20. The orbital track 16 is shaped to an ideal traversal path of a golf club to strike a golf ball. The orbital track 16 is defined by a progressively increasing radius between a top, back swing end 11 of the orbital track 16 and a lower follow through end 13 of the orbital track 16.

Figure 2:
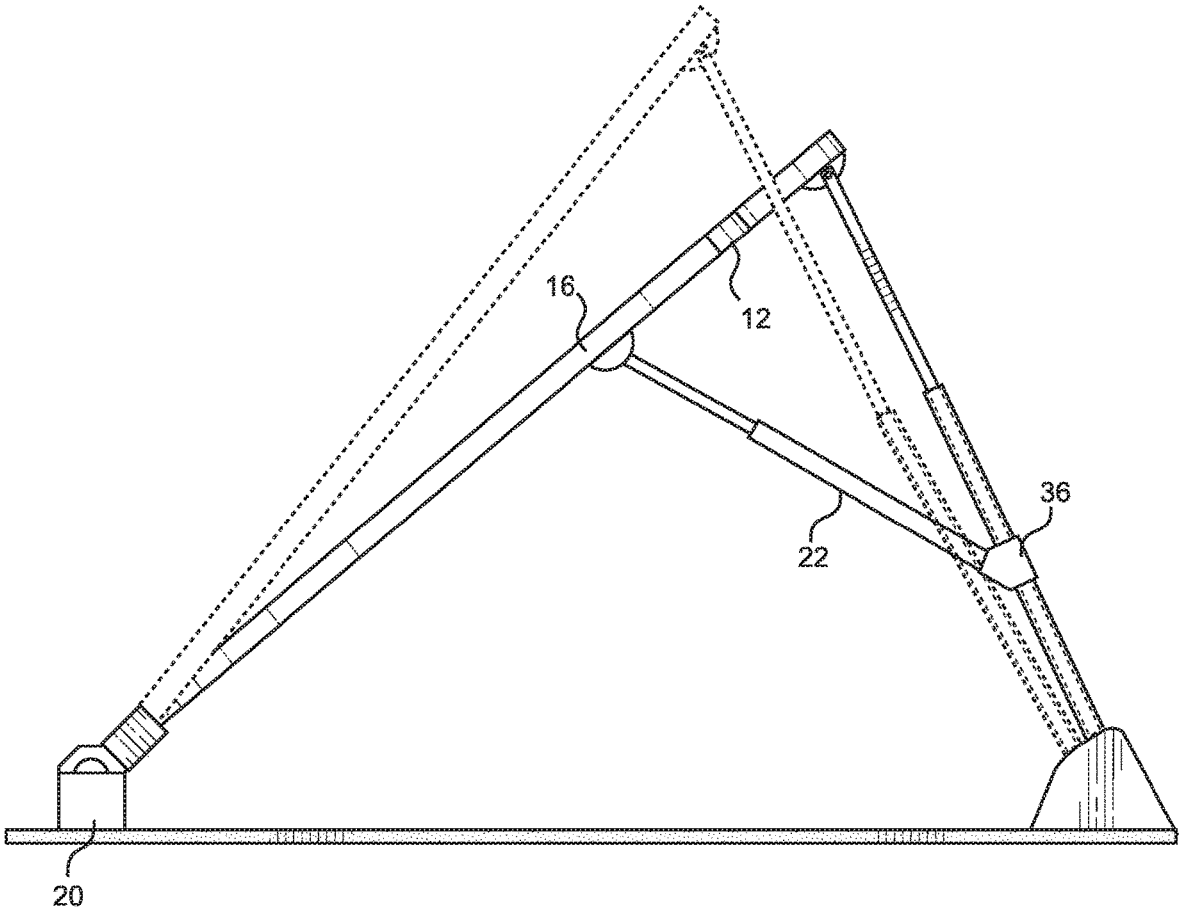
FIG. 2 is a side view of the golf swing trainer, illustrating the adjustment of the angle.
Figure 3:
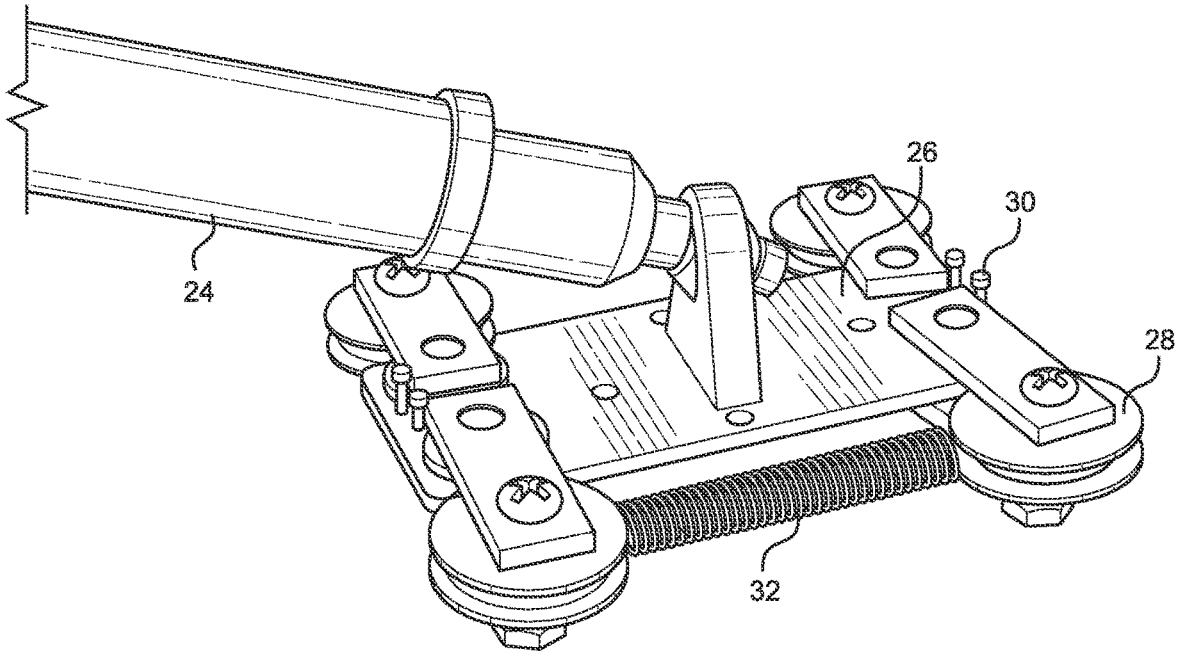
FIG. 3 is a perspective view of the roller board.
Figure 4:
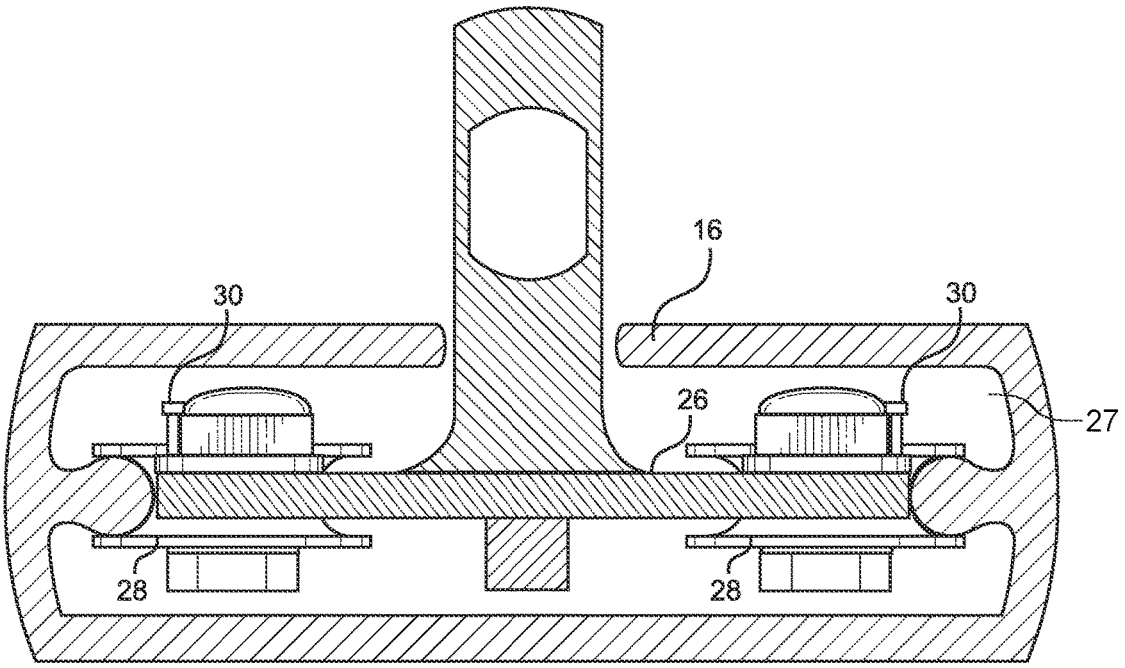
FIG. 4 is a side cutaway view of the roller board interacting with the track.
Figure 5:
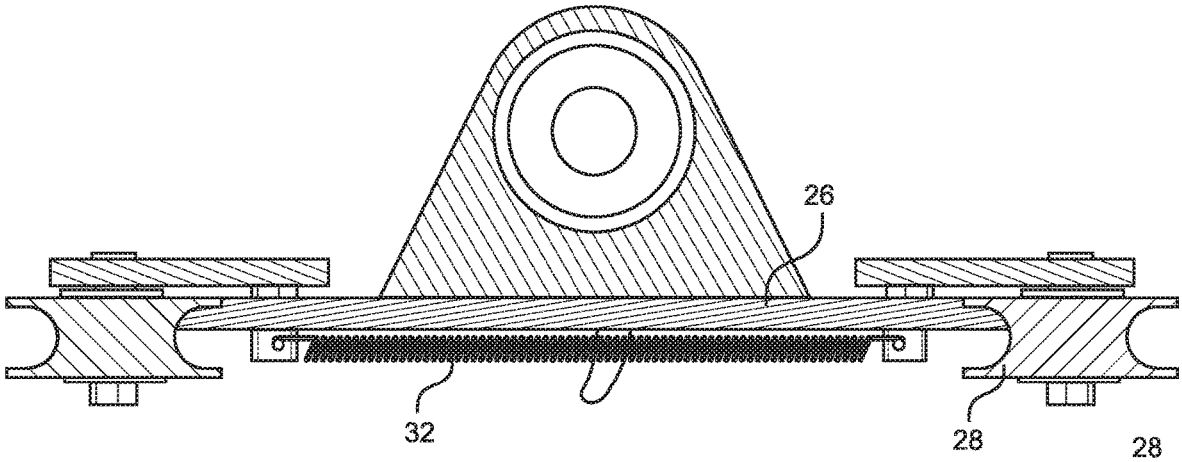
FIG. 5 is a side cutaway view of the roller board.
Figure 6:
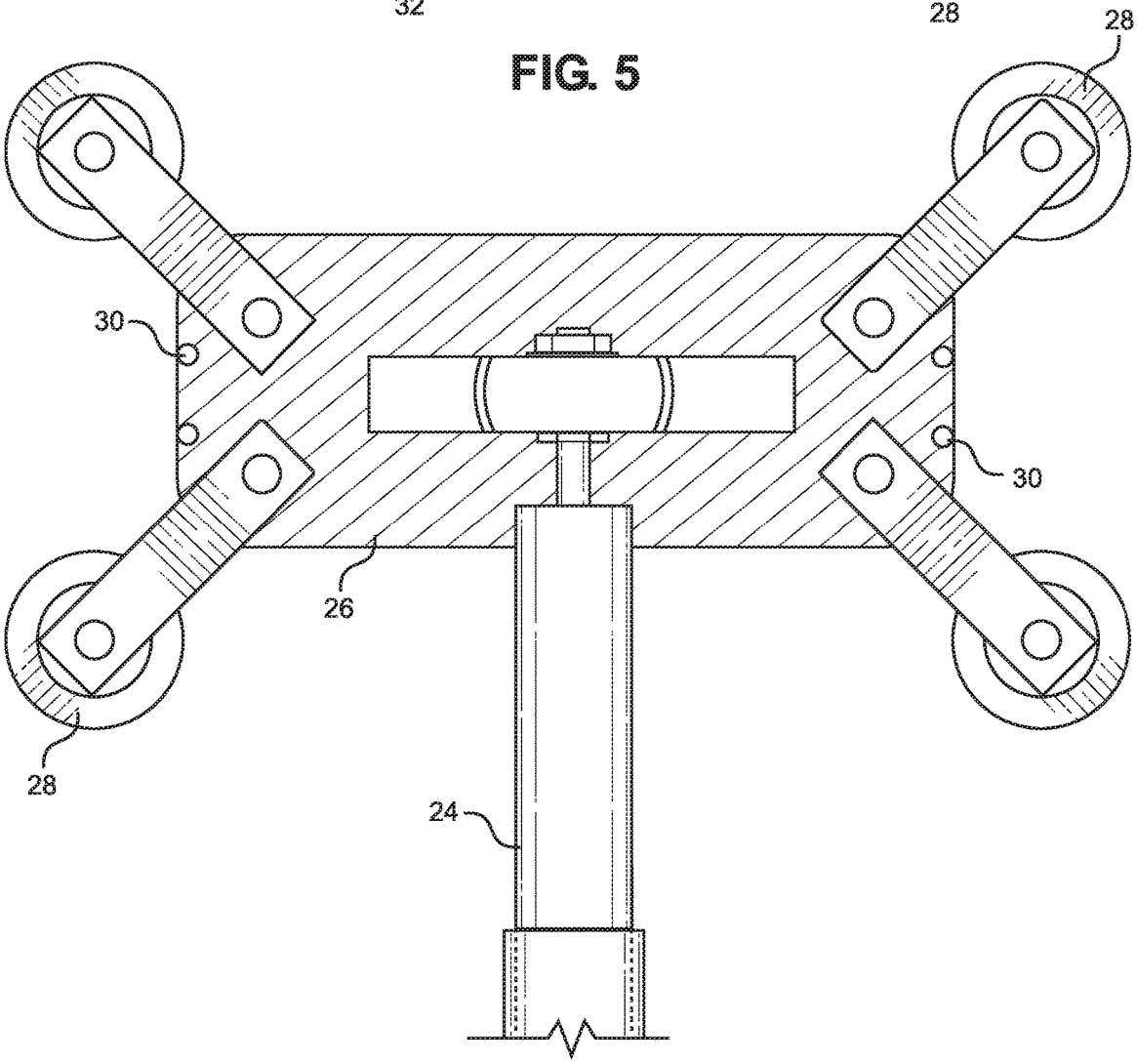
FIG. 6 is a top cutaway view of the roller board.

A stiffer 12 interconnects the back swing end 11 and the follow through end 13 of the orbital track 16 to retain the orbital track in alignment when the swing trainer 10 is used. As best seen in FIG. 2, the orbital track 16 is supported in a desired vertical plane via a plurality of support rods 22.

The support rods 22 may be adjustable in length to adjust the vertical plane of the orbital track 16. A knuckle 36 may interconnect the plurality of support rods 22. The knuckle 36 permits pivotal movement of the support rods 22 as the desired vertical plane of the orbital track 16 is varied to accommodate the anthropomorphic measurements of the golfer training with the swing training device 10.

The orbital track 16 has a channel 27 in which a carrier plate 26 having a plurality of rollers 28 is received. The plurality of rollers 28 may be biased into engagement within the channel 27. The plurality of rollers 28 may be pivotally carried on distal ends of arms 29 extending from the carrier plate 26. A stop 30 may be provided to limit travel of the arms 29. The plurality of rollers 28 may be biased by a spring 32 between an inner and an outer set of rollers 28. The plurality of rollers 28 may engage with a rail 31 carried within the channel 27.

A tension cable 14 may be provided at one of the backswing end 11 and the follow through end 13. The tension cable 14 may connect to the carrier plate 26. The tension cable 14 provides a selective resistance to the carrier plate 26 as the golfer swings the club shaft 24 while training with the swing training apparatus 10.

As indicated previously, the club shaft 24 is attached to the carrier 26 via a pivot 33 to accommodate the anthropomorphic measurements of the golfer and the movement of the club shaft 24 throughout the swing plane. Likewise, the club shaft 24 is extensible and retractable automatically in its longitudinal length to accommodate for the anthropomorphic measurements of the golfer 38. The longitudinal length of the club shaft 24 works in a telescopic manner during the swing motion.

Figure 7:
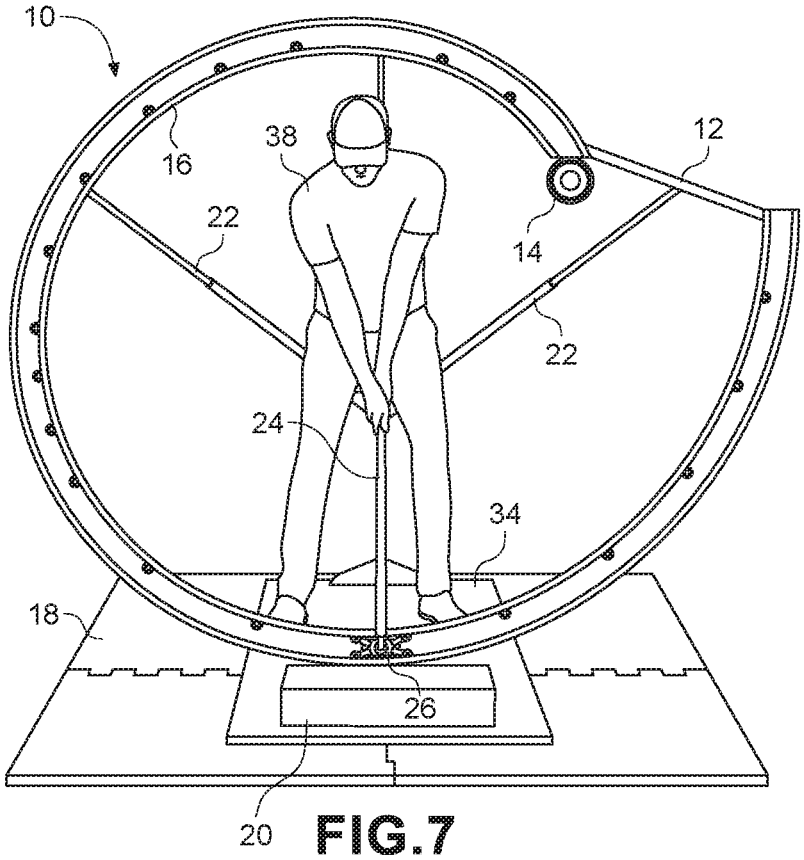
FIG. 7 is a front view of the golf swing trainer, shown in use during the setup of the swing.
Figure 8:
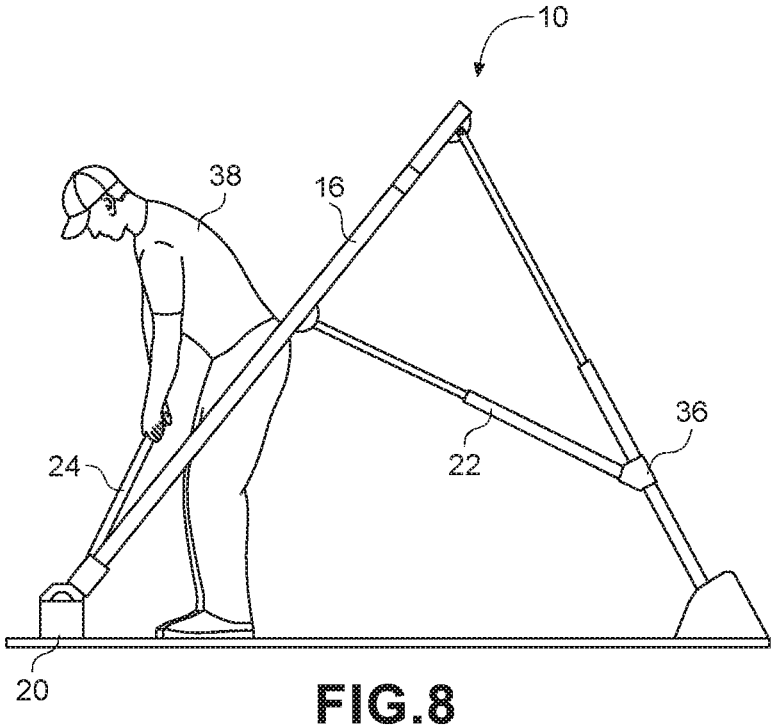
FIG. 8 is a side view of the golf swing trainer, shown in use during the setup of the swing.
Figure 9:
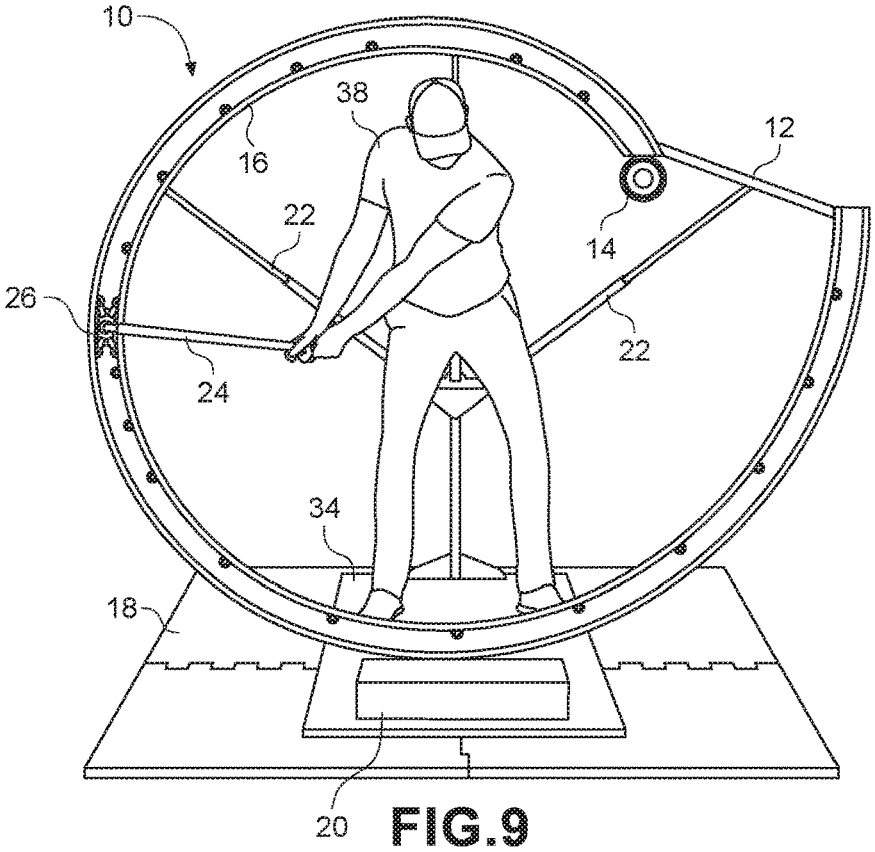
FIG. 9 is a front view of the golf swing trainer, shown in use during the takeaway of the swing.
Figure 10:
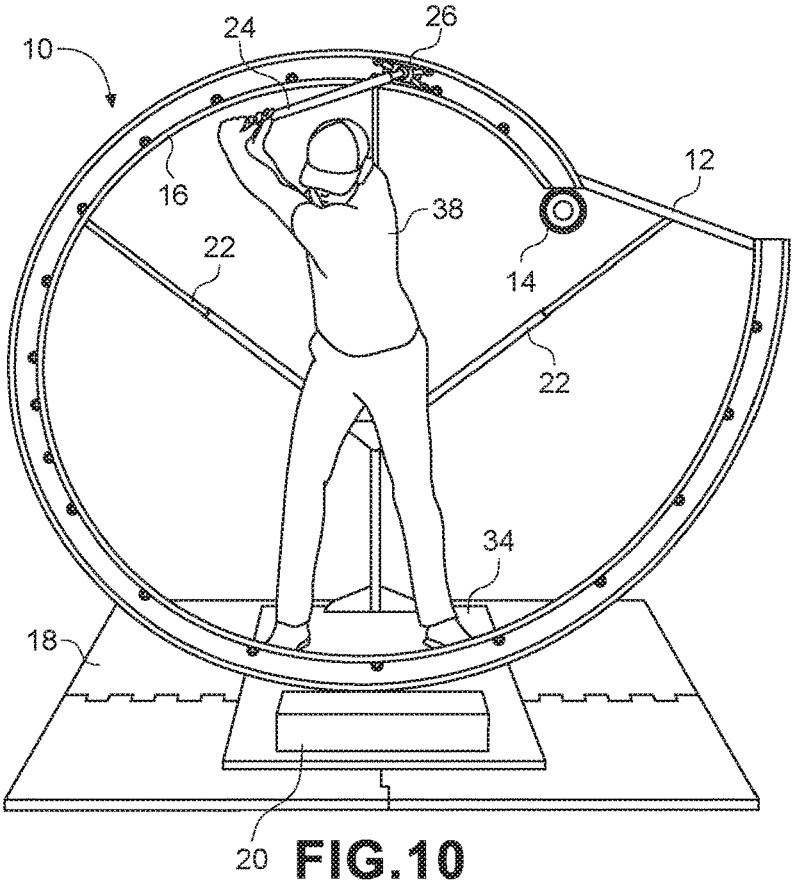
FIG. 10 is a front view of the golf swing trainer, shown in use during the top of the backswing.

A method of using the swing training apparatus 10 of the present invention is illustrated in reference to FIGS. 7-12. In FIG. 7, the golfer 38 stands on a mat 34 positioned within the swing training apparatus 10 and addresses the relative position of a golf ball. As seen in reference to FIG. 8, the swing plane of the golf swing training apparatus 10 is automatically adjusted to the anthropomorphic measurements of the golfer 38.

Once the swing plane of the golf swing training apparatus 10 is set, the golfer 38 may begin training. Holding the club shaft 24, the golfer 38 initiates a backswing, as seen in reference to FIG. 9. As the golfer 38 swings, the carrier 26 traverses within the orbital track 16. The golfer 38 continues the backswing to an upper limit proximal to the top end 13 of the orbital track 16.

Figure 11:
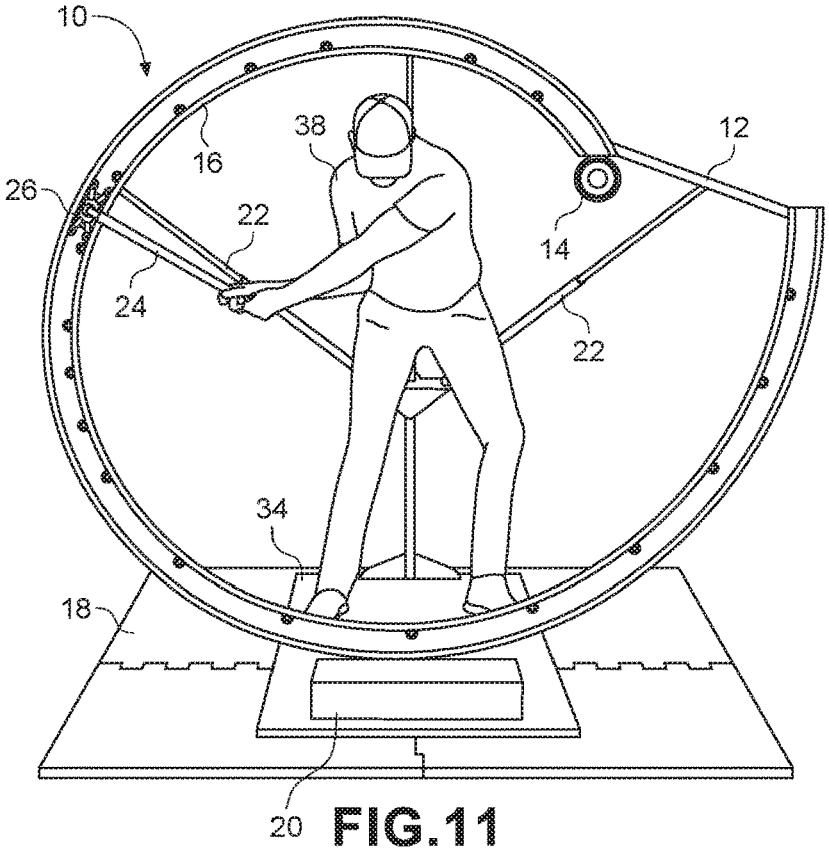
FIG. 11 is a front view of the golf swing trainer, shown in use during the downswing.
Figure 12:
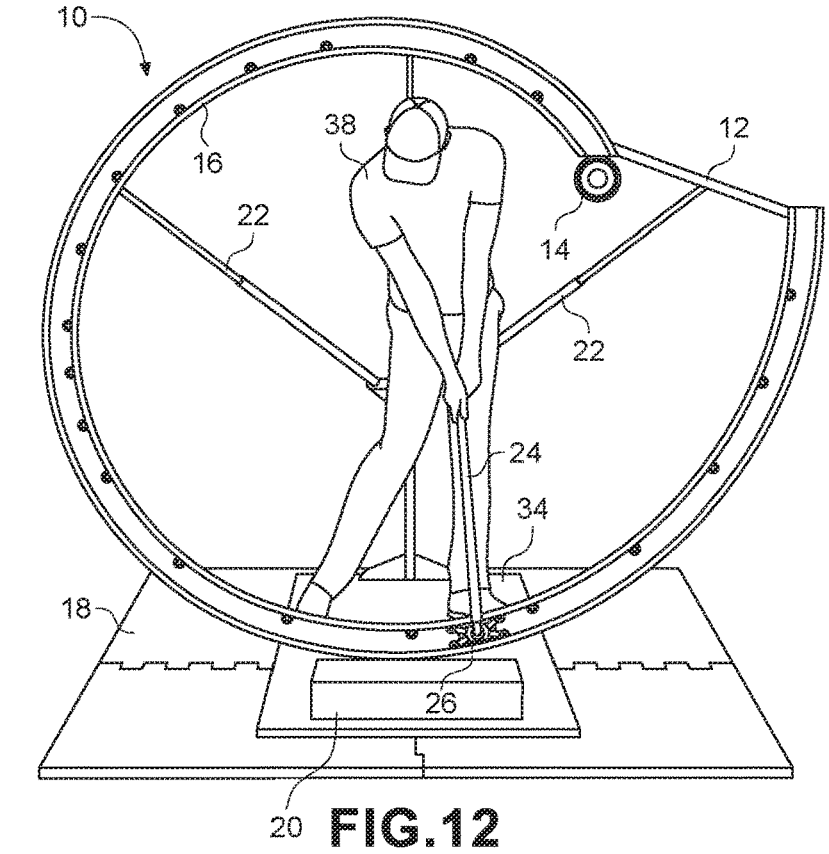
FIG. 12 is a front view of the golf swing trainer, shown in use during the bottom of the swing.

As seen in reference to FIGS. 11 and 12, the golfer 28 initiates a down stroke and continues to swing through the ball. As shown, the golf swing training apparatus 10 of the present invention allows the golfer 28 to swing in the exact same swing plane with every repetition. With the adjustments to the tensioner 14, the apparatus 10 also allows the golfer 38 to strengthen the muscles that are used to swing a golf club. The golf swing training apparatus 10 assists the golfer to develop the requisite muscle memory by swinging in the same plan/path every time you swing using this device.

It should be understood, of course, that the foregoing relates to exemplary embodiments of the invention and that modifications may be made without departing from the spirit and scope of the invention as set forth in the following claims.

What is claimed is:

1. A golf swing training apparatus, comprising:

an orbital track that is pivotally adjustable in a desired golf swing plane;

a club shaft; and a carrier plate coupling the club shaft to the orbital track such that the club shaft is carried in the desired golf swing plane throughout a swing motion of the club shaft; and a tension cable disposed at one of a backswing end and a follow through end of the orbital track, the tension cable connected to the carrier plate to provide a selective resistance to the carrier plate as the carrier plate traverses the orbital track.

2. The golf swing training apparatus of claim 1, further comprising:

a base pivotally coupled to a bottom end of the orbital track proximal to a ball strike zone of a golf swinging movement.

3. The golf swing training apparatus of claim 1, wherein the orbital track is shaped to an ideal traversal path of a golf club to strike a golf ball.

4. The golf swing training apparatus of claim 3, wherein the orbital track is defined by a progressively increasing radius between a back swing end of the orbital track and a follow through end of the orbital track.

5. The golf swing training apparatus of claim 4, further comprising:

a stiffer interconnecting the back swing end of the orbital track and the follow through end of the orbital track to retain the orbital track in alignment in the desired golf swing plane.

6. The golf swing training apparatus of claim 1, further comprising:

a plurality of support rods configured to adjustably align the orbital track the desired golf swing plane.

7. The golf swing training apparatus of claim 6, further comprising:

a knuckle interconnecting the plurality of support rods.

8. The golf swing training apparatus of claim 1, further comprising:

a channel defined within the orbital track; and a plurality of rollers disposed about the carrier plate, the plurality of rollers biased into engagement within the channel.

9. A golf swing training apparatus, comprising:

an orbital track that is pivotally adjustable in a desired golf swing plane, the orbital track is shaped to an ideal traversal path of a golf club to strike a golf ball, the orbital track defined by a progressively increasing radius between a back swing end of the orbital track and a follow through end of the orbital track;

a stiffer interconnecting the back swing end of the orbital track and the follow through end of the orbital track to retain the orbital track in alignment in the desired golf swing plane;

a club shaft; and a carrier plate coupling the club shaft to the orbital track such that the club shaft is carried in the desired golf swing plane throughout a swing motion of the club shaft.

10. The golf swing training apparatus of claim 9, further comprising:

a base pivotally coupled to a bottom end of the orbital track proximal to a ball strike zone of a golf swinging movement.

11. The golf swing training apparatus of claim 9, further comprising:

a plurality of support rods configured to adjustably align the orbital track in the desired golf swing plane.

12. The golf swing training apparatus of claim 11, further comprising:

a knuckle interconnecting the plurality of support rods.

13. The golf swing training apparatus of claim 9, further comprising:

a channel defined within the orbital track; and a plurality of rollers disposed about the carrier plate, the plurality of rollers biased into engagement within the channel.

14. The golf swing training apparatus of claim 9, further comprising:

a tension cable disposed at one of a backswing end and a follow through end of the orbital track, the tension cable connected to the carrier plate to provide a selective resistance to the carrier plate as the carrier plate traverses the orbital track.

15. A method of golf swing training, comprising:

placing a golf swing training apparatus on a supporting ground surface, the golf swing training apparatus having an orbital track defined by a progressively increasing radius between a back swing end and a follow through end of the orbital track, a carrier plate coupled for traversal along the orbital track, and a club shaft attached to the carrier plate:

adjusting a swing plane of the orbital track to one or more anthropomorphic measurements of a golfer training with the golf swing training apparatus; and adjusting a tensioner cable operatively coupled to the carrier plate to provide a selected resistance to the club shaft when swung in the swing plane.

16. The method of claim 15, further comprising:

automatically adjusting a longitudinal length of the club shaft during the swing motion.

17. The method of claim 16, further comprising:

swinging the club shaft in the swing plane between the back swing end and the follow through end.

* * * * *